US005791496A

United States Patent [19]

Strangalies

[11] Patent Number: 5,791,496

[45] Date of Patent: Aug. 11, 1998

[54] AIR-PULSED JIGGING MACHINE WITH SAFETY MEANS AGAINST BLOW THROUGH

[75] Inventor: Walter Strangalies, Altenholz, Germany

[73] Assignee: allmineral Aufbereitungstechnik GmbH & Co. KG, Duisburg, Germany

[21] Appl. No.: 572,961

[22] Filed: Dec. 15, 1995

[30] Foreign Application Priority Data

Dec. 15, 1994 [DE] Germany ..... 44 44 640.3

[51] Int. Cl.[6] ..... B03B 5/24

[52] U.S. Cl. ..... 209/455

[58] Field of Search ..... 137/209, 251.1; 209/455

[56] References Cited

U.S. PATENT DOCUMENTS 959,473 5/1910 Dandridge et al. ..... 209/455

FOREIGN PATENT DOCUMENTS 3622551 1/1988 Germany .

OTHER PUBLICATIONS

Schubert "Aufbereitung fester mineralischer Rohstoffe", vol. II, VEB Deutscher . . . Grundstoffindustrie, Leipzig, pp. 83–86.

*Primary Examiner*—Gerald A. Michalsky

*Attorney, Agent, or Firm*—Robert W. Becker & Associates

[57] ABSTRACT

A jigging machine for treating minerals has a jigging tank with a jigging container and an air chamber. The jigging tank contains water. The air chamber has at least one inlet valve and at least one outlet valve. A compressed air supply is connected to the at least one inlet valve. Compressed air is pulsed via the at least one inlet valve into the air chamber for forcing the water contained in the jigging tank from the air chamber into the jigging container and, after each pulse of compressed air, the water flows back into the air chamber and forces the air out of the air chamber via the at least one outlet valve. The air chamber has an outlet opening positioned below the lowest permissible water level occurring during a jigging pulse. This outlet opening is constantly open during operation of the jigging machine.

2 Claims, 1 Drawing Sheet

AIR-PULSED JIGGING MACHINE WITH SAFETY MEANS AGAINST BLOW THROUGH

BACKGROUND OF THE INVENTION

The present invention relates to an air-pulsed jigging machine for treating minerals. The device comprises an air chamber for generating the pulsating air stream which has at least one inlet valve for connecting the air chamber to the compressed air supply and at least one outlet valve connected to an exhaust line, whereby via the inlet valve the compressed air is pulsed into the air chamber and the water is forced from the air chamber into the jigging container. Subsequently, the pulsed air is forced out of the air chamber via the outlet valve due to the water flowing back into the air chamber.

A jigging machine of the aforementioned kind is disclosed in particular with respect to its function in German Patent Application 36 22 551. Different embodiments of such jigging machines are known, for example, from Schubert "Aufbereitung fester mineralischer Rohstoffe", Vol. II, VEB Deutscher Verlag für Grundstoffindustrie, Leipzig, 3rd edition, pp. 83and 86, wherein the air chamber of so-called laterally pulsed jigging machines are arranged laterally with respect to the jigging container and in so-called BATAC jigging devices are positioned below the jigging container, respectively, jigging bed. In both designs of air-pulsed jigging machines the risk of blow through is present which occurs when during the jigging pulse the introduced compressed air forces the water level of the jigging water within the air chamber below the lowest permissible level so that the pulsed air can transfer from the air chamber directly into the jigging container.

It is therefore an object of the present invention to provide a jigging machine of the aforementioned kind with which blow through can be prevented.

SUMMARY OF THE INVENTION

A jigging machine for treating minerals according to the present invention is primarily characterized by:

A jigging tank comprising a jigging container and an air chamber;

The jigging tank containing water;

The air chamber having at least one inlet valve and at least one outlet valve;

A compressed air supply connected to the at least one inlet valve, wherein compressed air is pulsed via the at least one inlet valve into the air chamber for forcing the water contained in the jigging tank from the air chamber into the jigging container wherein after each pulse of compressed air the water flows back into the air chamber and forces the air out of the air chamber via the at least one outlet valve; and Wherein the air chamber comprises an outlet opening positioned below the lowest permissible water level occurring during a jigging pulse, the outlet opening being continuously open during operation of the jigging machine.

Advantageously, the jigging machine further comprises a valve for controlling an opening cross-section of the outlet opening.

According to the present invention, the air chamber is provided with an outlet opening positioned below the lowest permissible water level of the jigging pulse. This outlet opening is maintained open constantly during operation of the jigging machine. This results in the advantage that upon falling below the lowest permissible level (i.e., before an actual blow through occurs), the outlet opening is freed from the water column which during normal operation of the jigging machine covers the outlet opening so that the excess of compressed air, respectively, the compressed air which is still being introduced can be removed from the jigging tank via this outlet opening without forcing the water level within the air chamber to a level at which blow through would occur. In order to avoid the otherwise required control expenditure, the outlet opening during the operation of the jigging machine is constantly maintained open so that during operation a small amount of water constantly exits through the outlet opening. The invention uses the knowledge that for an open outlet opening approximately the tenfold amount of air can be guided therethrough as compared to the amount of water which exits therethrough during normal operation of the jigging machine so that a correspondingly small opening cross-section is sufficient in order to provide for a sufficient amount of air being expulsed from the air chamber in dangerous situations.

According to one embodiment of the invention the outlet opening is controlled with respect to its opening cross-section by a valve. It can furthermore be provided that the water, which continuously exits via the outlet opening during operation of the jigging machine, is recirculated at a suitable location of the system.

BRIEF DESCRIPTION OF THE DRAWINGS

The object and advantages of the present invention will appear more clearly from the following specification in conjunction with the accompanying only drawing, showing an air-pulsed jigging machine in the embodiment of a laterally pulsed jigging device in a schematic side view.

DESCRIPTION OF PREFERRED EMBODIMENT

Figure 1:
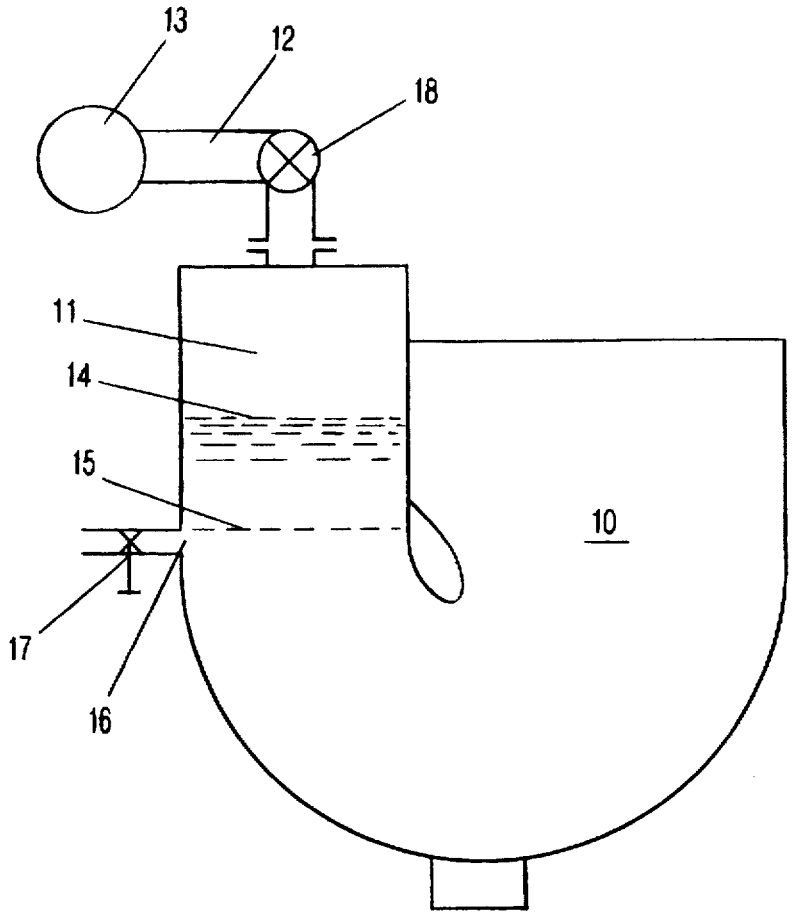

The present invention will now be described in detail with the aid of a specific embodiment utilizing the only Figure.

The jigging container 10 of a jigging tank of a jigging machine has coordinated therewith an air chamber 11 which is connected via an inlet line 12 to the air tank 13 for supplying the air chamber 11 with compressed air. A rotary piston slide valve 18 is positioned within the inlet line 12 which functions alternatingly as an inlet valve and outlet valve whereby the outlet side of the jigging machine is not represented in the drawing. At 14 the average working level of the jigging water level during normal operation of the jigging machine is shown, and the dashed line 15 indicates the lowest permissible level of the water within the air chamber. The water level should not drop below level 15 to a greater extent when blow through of the jigging machine is to be prevented. Directly below the level 15 an outlet opening 16 is arranged within the air chamber 11. This opening 16 is controllable by a valve 17. The valve 17 is open constantly during operation of the jigging machine.

When during the jigging pulse the water level of the jigging water is pushed in the direction of the jigging container 10 to a level at which the risk of blow through of the pulsed air within the air chamber 11 into the jigging container 10 is present, the water level which is falling now frees the outlet opening 16 within the air chamber 11 which is arranged at the corresponding safety level so that via this outlet opening 16, respectively, the slightly opened valve 17 the pulsed air can flow out without forcing the water level within the air chamber 11 below the critical level.

The shown arrangement can be used in the same manner for laterally pulsed as well as for bottom-pulsed jigging machines.

The present invention is, of course, in no way restricted to the specific disclosure of the specification and drawings, but also encompasses any modifications within the scope of the appended claims.

What I claim is:

1. A jigging machine for treating minerals, said jigging machine comprising:

a jigging tank comprising a jigging container and an air chamber;

said jigging tank containing water;

said air chamber having at least one inlet valve and at least one outlet valve;

a compressed air supply connected to said at least one inlet valve, wherein compressed air is pulsed via said at least one inlet valve into said air chamber for forcing the water contained in said jigging tank from said air chamber into said jigging container and wherein after each pulse of compressed air the water flows back into said air chamber and forces the air out of said air chamber via said at least one outlet valve; and wherein said air chamber comprises an outlet positioned below a lowest possible water level occurring during a jigging pulse, said outlet being continuously open during operation of said jigging machine to allow pulsed air to escape in order to prevent blow through.

2. A jigging machine according to claim 1, further comprising a valve for controlling an opening cross-section of said outlet.

* * * * *